United States Patent [19]

Raggam et al.

[11] Patent Number: 4,556,452

[45] Date of Patent: Dec. 3, 1985

[54] PROCESS AND APPARATUS FOR PRODUCING PULP

[75] Inventors: Augustin Raggam, St. Margarethen; Hermann Rabitsch, Vienna, both of Austria

[73] Assignee: Simmering-Graz-Pauker Aktiengesellschaft, Vienna, Austria

[21] Appl. No.: 590,475

[22] Filed: Mar. 16, 1984

Related U.S. Application Data

[62] Division of Ser. No. 322,232, Nov. 17, 1981, Pat. No. 4,451,331.

[30] Foreign Application Priority Data

Nov. 20, 1980 [AT] Austria ..... 5680/80
Oct. 27, 1981 [AT] Austria ..... 4564/81

[51] Int. Cl.[4] ..... D21C 7/00

[52] U.S. Cl. ..... 162/233; 162/246; 162/250; 162/251

[58] Field of Search ..... 162/233, 246, 250, 251; 100/72, 73, 92, 115, 116, 244, 245, 93 P

[56] References Cited

U.S. PATENT DOCUMENTS

| | | | |
|---|---|---|---|
| 1,991,245 | 2/1935 | de la Roza, Sr. | 162/18 |
| 1,991,248 | 2/1935 | de la Roza, Sr. | |
| 2,067,480 | 1/1937 | de la Roza, Sr. | 162/18 |
| 2,072,086 | 3/1937 | de la Roza | |
| 2,159,258 | 5/1939 | de la Roza, Sr. | 162/18 |
| 2,582,054 | 1/1952 | Michon | 162/233 |
| 2,771,361 | 11/1956 | Birdseye et al. | |
| 4,346,653 | 8/1982 | Rodak | 100/116 |

FOREIGN PATENT DOCUMENTS

| | | |
|---|---|---|
| 1101126 | 3/1941 | Fed. Rep. of Germany . |
| 1047000 | 12/1958 | Fed. Rep. of Germany . |
| 1132423 | 6/1962 | Fed. Rep. of Germany . |

OTHER PUBLICATIONS

Kleinert, T. N. *Tappi* vol. 51, No. 10, 10/68, pp. 467–470.

Kleinert, T. N. *Pulp Pap Mag Can* 7/64, T-27-5-T-783.

Article "Neue Technologische Tendenzen fur die Europaische Papierindustrie", in Das Papier, 1974, No. 10A, pp. V125 to V129, by H. Bouchayer, with an English translation of the revelant part on p. V128, marked with red.

*Primary Examiner*—William F. Smith

*Attorney, Agent, or Firm*—Fleit, Jacobson, Cohn & Price

[57] ABSTRACT

A process and apparatus for producing pulp from impregnated cellulose-containing starting materials such as wood, straw, grass, waste materials etc. in a compacting apparatus comprising a shell (1) and two mutually opposite pistons (4, 4') contained in said shell. The material to be compacted is disposed between said pistons and constitutes a resistive electrical load. The pistons are movable relative to each other and the shell is movable relative to the pistons. The impregnated starting materials are digested at a relatively low hydromodulus of 0.5 to 2 with a direct action of heat on the impregnated starting materials in the compacting apparatus at a digesting temperature of 160° to 300° C. The digesting times are short and depend on the digesting temperature.

16 Claims, 7 Drawing Figures

PROCESS AND APPARATUS FOR PRODUCING PULP

This is a divisional of application Ser. No. 322,232 filed Nov. 17, 1981, now U.S. Pat. No. 4,451,331.

SUMMARY OF THE INVENTION

A process and apparatus for producing pulp from impregnated cellulose-containing starting materials in a compacting apparatus comprising a shell (1) and two relatively movable pistons (4, 4') contained in said shell. The material to be compacted is disposed between said pistons. The impregnated starting materials are digested at a hydromodulus of 0.5 to 2 and at a digesting temperature of 160° to 300° C. in that heat is directly supplied to the material to be compacted, e.g. in that said material is used as a resistive electrical load or by a supply of steam.

This invention relates to a process of producing pulp from impregnated, cellulose-containing starting materials, such as wood, straw, grass, waste materials, etc. which are digested under pressure and at elevated temperature, and to an apparatus carrying out that process.

The disintegrated starting materials, such as wood chips, are impregnated in conventional manner in that the wood chips are mixed with a basic or acid cooking liquor and are slowly heated to a temperature of 80° to 105° C. in large pressure vessels. A slow heating, a holding time of 0.5 to 2 hours at said temperature, and a resulting pressure of up to 10 bars are required to ensure that the cooking liquor will reliably enter the wood chips and impregnate the same. Sulfate or sulfite solutions having a chemical concentration of about 5 to 10% are presently preferred as cooking liquors. The ratio of the weight of the cooking liquor absorbed by the wood chips to the weight of the dry wood chips in the digester is described as the hydromodulus H, and by presently known digesting processes is about 3 to 5. The impregnation may also be effected outside the digester in a separate unit. German Patent Publication No. 1,132.423 suggests to use for this purpose a pressure chamber, in which the chips are contacted with the cooking liquor under a hydrostatic pressure of about 7 bars for some minutes. In another impregnating process, described in German Patent Publication No. 1,101.126, the starting materials are gradually compacted to expel air and pressure and are then subjected to a pressure relief in a chamber that is sealed from the atmosphere. During the pressure relief, the starting materials are contacted with an impregnating solution, into which the starting materials are subsequently immersed. This is effected by a screw extruder, by which a continuous impregnation can be effected. By repeated compacting and pressure relief cycles, surplus liquid or impregnating material is removed during the compacting operation.

When impregnating is effected in pressure vessels, as mentioned above, the subsequent digestion is initiated by a supply of additional heat until the reaction temperature of 120° to 195° C. required to dissolve the lignin has been reached; at the same time, the steam pressure rises up to 14 bars. About one-half of the wood substance is dissolved too, 6 to 10 liters of spent cooking liquor become available per kg of pulp and, in addition to the processing chemicals, contain 1 kg of dissolved organic wood substance, mainly lignin (mother liquor). The digesting times vary between 2 and 20 hours depending upon the process conditions (temperature and pH value).

In a continuously operating plant described in U.S. Pat. No. 2,771,361, a mixture of hot cooking liquor (at 87° C.) and impregnated wood chips is supplied by means of a pump to a heated cooking zone or cooking conduit. In an example which has been described, the digesting temperature in that zone is about 170° C. (steam pressure about 8 bars) whereas the transit time is about 60 minutes. In the second example which has been described which relates to a semichemical pulping process, in which a digesting temperature of to 198° C. and a steam pressure up to about 16 bars are used and the transit time is 10 minutes. In the screw extruder provided at the end of the digesting zone, the cooking liquor in which the lignin is dissolved is squeezed out. At the same time, the chips are defibrated by the frictional forces exerted in the screw extruder. The chips which are under liquid pressure burst during the subsequent pressure relief.

U.S. Pat. No. 1,991,243 describes an elongated digester for a continuous cooking operation, which involves the general problem of the feeding of the material to be digested and the discharging of the digested material into and out of the pressure vessel. In an attempt to solve that problem, the known method of forming a plug at the inlet by means of a piston has been suggested and there is a vague reference to the use of electric power for heating, but concrete technical means for that purpose have not been disclosed. The consistencies of 9, 12, 15, 20 and 30 pounds per cubic foot which have been stated correspond to hydromoduli of about 6, 4.2, 3.2, 2.1 and 1.1, respectively, if the cooking liquor has a density of 1 gram per cubic centimeter. In that case the highest consistency in the cooking vessel would correspond to the hydromodulus of 2.1 and the highest consistency at the inlet to a hydromodulus of 1.1. In consideration of the above definition of the hydromodulus, in which the higher density of the cooking liquor is not taken into account, the hydromodulus will be much higher than 2 during the digestion in the vessel and for this reason will lie outside the range proposed by the invention. Regarding the hydromodulus of 1.1 at the inlet, it must be stated that a homogeneous and effective impregnation will not be possible unless the impregnation is effected at a much higher hydromodulus and the slurry is then squeezed to a hydromodulus of 1.1. For this reason it is doubtful whether the teaching of the U.S. Patent Specification will be practicable if the slurry has initially only a hydromodulus of 1.1. The cooked material will have only the quality of a semichemical pulp, at best. If additional liquor is added to the digester in order to improve the quality of the pulp, the consistencies or hydromoduli which have been stated cannot be adhered to.

The impregnating, compacting and digesting steps are usually succeeded by washing, sorting, bleaching and drying steps. In spite of great efforts made in the ecological field, modern pulping plants still consume large quantities of energy and water. The high energy consumption is mainly due to the heating of large quantities of liquid, particularly for digesting and bleaching, as well as to long residence times and to the low efficiency of heat-recovering plants.

If energy required in a pulping plant is derived from the organic substances contained in the spent liquor, the thin waste liquor which becomes available must be thickened to a solids content of 55 to 65% before it can be burnt. This thickening also requires a large quantity of energy. The energy required in a pulping plant is used in approximately equal parts for digesting, leaching, evaporation of liquor, and pulp drying. In very modern factories, so much energy can be recovered by the burning of the thickened waste liquor that the pulping plant is almost self-sufficient as regards energy. In this connection reference is made to H. BOUCHAYER, "Neue technologische Tendenzen für die Europäische Papierindustrie", in "Das Papier", 1974, No. 10A, pages V125 to V129. BOUCHAYER indicates that 50 to 90% of the entire energy required in the production of pulp is used to heat the diluted pulp slurry to the reaction temperature in the cooking and bleaching processes. Other experts have also indicated the large quantities of heat and water required in the known pulping processes owing to the high dilution.

It is an object of the invention to provide a process in which the consumption of energy, water and chemicals is minimized. The methods used for that purpose will contribute to an optimum solution to the ecological problem of a pulping plant as regards energy consumption and sewage disposal.

In view of the great difficulties involved in the disposal of sewage from pulping plants, it is highly important to minimize the quantity of sewage. The process according to the invention should also reduce the bulk of the equipment so that smaller plants can also be operated economically and can be adjusted to the quantity of wood which is supplied at a time.

It is also an object of the invention to increase the quality of the pulp which is produced.

In the process of producing pulp which has been described first hereinbefore, these objects are accomplished in accordance with the invention in that the impregnated starting materials are digested at a relatively low hydromodulus of 0.5 to 2, preferably 1, with a direct supply of heat to the impregnated starting materials, preferably by an electric heating of the impregnated starting materials, within a compacting apparatus at a digesting temperature of 160° to 300° C., preferably 180° to 200° C. and within a short time, which depends on the digesting temperature and amounts to less than 10 minutes, e.g., from 10 to 60 seconds. Electric heating is preferably effected by resistance heating with direct or alternating current.

The main advantages afforded by the process according to the invention are short digesting times, a lower energy consumption, a lower chemical consumption, a lower liquid requirement and, as tests have shown, an improved quality of the pulp and a higher degree of utilization of the wood so that the conventional grinding operation which requires additional energy may be eliminated. The improved quality of the pulp is mainly due to the favorable position of the residual lignins and hemicelluloses and involves particularly good bonding and bleaching qualities.

Owing to short reaction times in general and the rapid separation of the fibers from each other during the softening of the lignin by the shearing forces which are mechanically applied by the compacting apparatus and overcome the structural resistance of the material, and owing to the fact that reactions can be quickly interrupted, e.g. by an interruption of the energy supply, the cellulose chains, which are important for the structural strength of the fibers, and the hemicelluloses, which are important for the bonding of the fibers in the finished paper, are preserved to a large extent. In this manner, the hemicelluloses are intentionally bonded to and concentrated at the surface of the fiber.

In the process according to the invention, impregnation is effected in the same compacting apparatus and with an impregnating liquor in the chemical concentrations required for digestion, and amounting preferably from 5 to 50%, e.g. from 10 to 20%, and under a constant pressure or under pressure surges, preferably above 1 bar, e.g. under 2 to 10 pressure surges of 10 to 50 bars, whereby the unwetted capillary length of the starting material is reduced and the impregnating time can be reduced by the application of pressure and preferably amounts to less than 10 minutes, suitably less than 1 minute, so that the impregnation can be effected in the cold and without a previous deaeration. That method of impregnation may desirably be adopted also to process mixtures of dry and wet starting material. During the impregnating step it is important that the entire interior and exterior surfaces of the chips are adequately and uniformly wetted with a smaller quantity of less concentrated cooking liquor in a quantity that is smaller than would correspond to the pore volume of the chips. This will be permitted if the entire pore volume of the chips is first filled entirely in the compacting apparatus under an applied pressure, as is usual in conventional plants, but with a more highly concentrated cooking liquor (definition of impregnation).

As about 2.5 liters of cooking liquor are required to fill the pore volume and to wet the surfaces of, e.g., 1 kilogram of spruce chips, the hydromodulus H of the impregnated starting materials must be decreased to the low value proposed by the invention. This is accomplished in that the impregnated starting materials are compacted in the same compacting apparatus.

The impregnation may alternatively be effected in a conventional process in a separate plant, if desired.

In an extreme case, where the hydromodulus H=0.5 and the waste liquor has a concentration of 61%, the evaporator may be eliminated and the waste liquor may be burnt directly. Pulping processes are known in which the chemicals are circulated and waste liquors having a solids content of 35% are burnt in boilers although the energy will be less efficiently used in such case.

The reduction of the hydromodulus H results in a decrease of the energy consumption for the digestion and evaporation of the waste liquor. The process according to the invention differs from the conventional process in that more highly concentrated cooking liquors are used in a smaller amount per charge, corresponding to the lower hydromodulus H. For this reason, the quantities of concentrated fresh and waste liquors to be processed are reduced so that all auxiliary plants may be reduced in number and size, and owing to the higher concentration the theoretical chemical consumption per kg of pulp can be reduced to about one-half of the conventional consumption.

The pressure applied to adjust the hydromodulus H may be lower if more time is available or if the temperature of the chips is increased so that they become more elastic and their structural resistance is reduced. Temperatures up to 130° C. have proved desirable because they do not involve appreciable digesting reactions and a hydromodulus H of about 1 is obtained within about 30 seconds at such temperatures if a mechanical pressure of about 50 bars is applied. Whereas a consistency of, e.g., 160 to 220 kg/m$^3$ is conventionally obtained in the conventional cooking of softwood, a higher consistency of 800 kg/m$^3$ will be obtained after the hydromodulus has been adjusted under a mechanical pressure of, e.g., 50 bars and at a temperature of 130° C. As a result of this step the required volume of the compacting apparatus is only one-third to one-fifth of the volume of the previous pressure vessel.

The hydromodulus may also be adjusted outside the compacting apparatus but that operation is much more complicated. In another embodiment of the process according to the invention, wet starting materials are squeezed in the same compacting apparatus to a moisture content below 50%, e.g., 20 to 40%, e.g., 30%, before they are impregnated so that a large portion of the capillaries of the starting material is rendered accessible for the impregnating liquor.

Heat may be directly supplied to the impregnated starting materials, e.g., by a capacitive or inductive radiofrequency heating or microwave heating.

In accordance with the invention, digesting may be effected in a continuous process. The invention may basically be applied to all (acid to alkaline) cooking processes. A compacting apparatus provided according to the invention for carrying out the process is characterized in that two pistons facing each other are disposed in a shell, the material to be compacted is disposed between said pistons and constitutes a resistive electrical load, the pistons are movable relative to each other and the shell is movable relative to the pistons.

Embodiments of apparatus for carrying out the novel process will now be described with reference to the drawings, in which.

Figure 1:
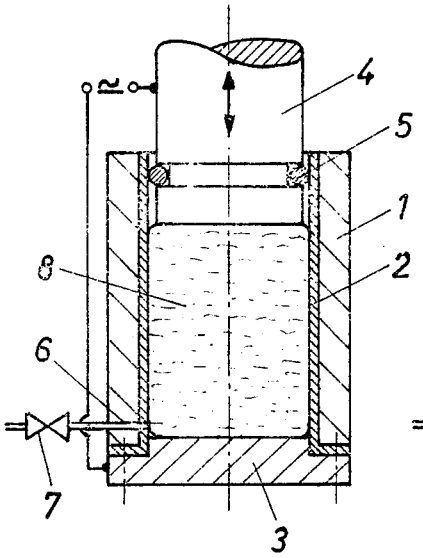
FIGS. 1 to 5 are transverse sectional views showing respective illustrative embodiments of compacting apparatus according to the invention.

FIG. 1 shows a basic embodiment of a compacting apparatus. A cylindrical shell 1 has an electrically insulating lining 2, which extends also on the lower rim of the shell 1 to insulate also the bottom member 3. A piston 4 is movable up and down in the shell 1 by the application of, e.g., hydraulic pressure, and is provided with a sealing element 5. The shell 1 is provided in its lower portion with an outlet opening 6 for spent liquor. The outlet opening 6 is connected to a pipeline, which incorporates a valve 7. The bottom member 3 and the piston 4 are provided with electric contacts, which are connected to the terminals of an electric power source. A.c. power sources are preferred, but d.c. power sources may be used, if desired. In this arrangement the mechanical pressure applied by the piston is assisted by the steam pressure which is generated by the heat that is due to the flow of electric current through the material 8 to be compacted.

Figure 2:
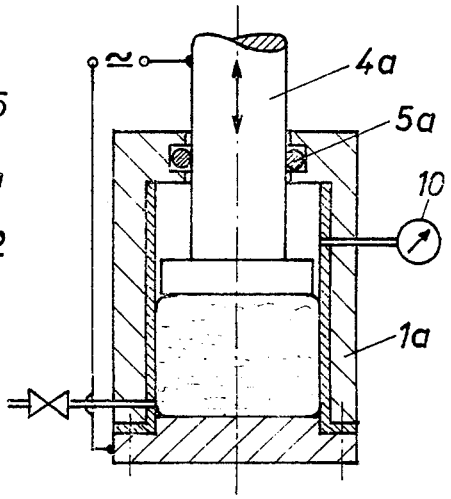

FIG. 2 shows a second embodiment which is similar to that of FIG. 1 but has a stepped piston 4*a*. The sealing element is provided in the upper portion of the shell 1*a*. A sensing opening 9 for connection to a steam pressure gauge 10 is provided in the upper one-third of the shell 1*a*. The steam which is generated can escape upwardly through the gap between the piston 4*a* and the shell 1*a*, so that the steam pressure and the mechanically applied pressure can be controlled and measured separately. Electric current is supplied as indicated in FIG. 1.

Figure 3:
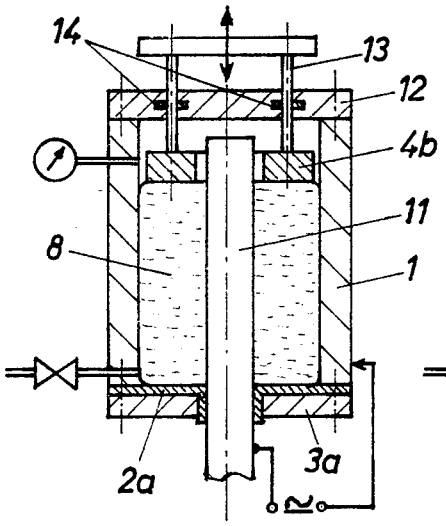

FIG. 3 shows a third embodiment, in which simpler means may be used for electrical insulation. The bottom member 3*a* has a central opening, through which an electrode 11 protrudes into the shell. An insulator 2*a* insulates the bottom member 3*a* from the shell 1 and the electrode 11. The shell 1 is closed at its top by a cover 12. A rod 13 extends through sealing elements 14 in the cover 12 into the interior of the shell and is connected to a piston ring 4*b*, to which the mechanical pressure is transmitted by the rod 13. The piston ring 4*b* applies mechanical pressure to the material 8 to be compacted. In this embodiment gaps are provided between the piston ring 4*b* and the shell 1 and between the electrode 11 and the piston ring 4*b* so that there is a steamspace above the material 8 to be compacted.

Figure 4:
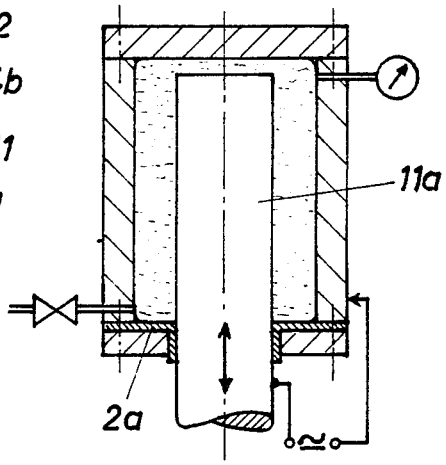

In the fourth embodiment, shown in FIG. 4, the electrode 11*a* is larger in diameter and also serves as a piston for applying mechanical pressure. That embodiment affords the advantage that no sealing elements are required; the insulator 2*a* serves also as a sealing element.

In accordance with the invention the compacted material subjected to mechanical pressure is heated, preferably by generation of heat by electric current flowing through the compacted material. As has been described hereinbefore, the electrodes may consist of the pistons and the shell and combinations thereof and the electrical insulating material is provided at those portions of the compacting chamber which would otherwise short-circuit the compacted material. That measure will also be used if inductive or capacitive radiofrequency heating or microwave heating is used and can be accomplished by a person skilled in the art in consideration of the above criterion.

Figure 5:
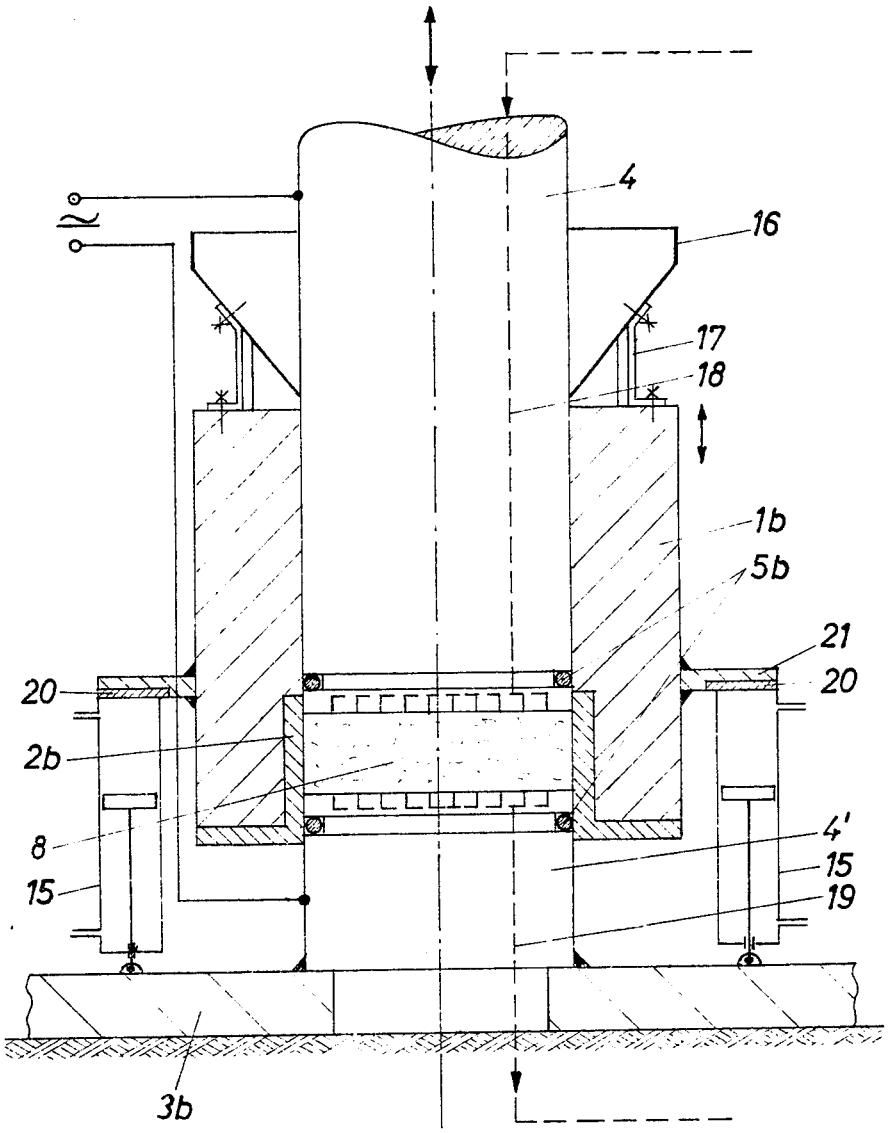

FIG. 5 is a transverse sectional view showing an illustrative embodiment of the compacting apparatus according to the invention. A shell 1*b* is provided, which can be hydraulically raised and lowered and contains a movable upper piston 4, which can be hydraulically raised and lowered, and a lower piston 4', which is rigidly connected to a bottom plate 3*b*. The compacted material 8 is disposed between the two pistons 4 and 4', each of which is provided with a sealing element 5*b*. The two pistons are provided with contacts, which are electrically connected to the terminals of an electric power source. The shell 1*b* is provided on its inside surface with insulation 2*b*, which prevents a flow of electric current through the shell. The shell 1*b* is raised and lowered by actuating means, which are connected to the bottom plate 3. These actuating means may consist of hydraulic or pneumatic cylinders 15 so that the compacted material can easily be discharged and the chips can be fed into the shell 1*b* through a funnel 16, which surrounds the upper piston 2 and is carried by brackets 17 mounted on the shell 1*b*. The actuating means may alternatively consist of a mechanism, e.g. a power screw. For the supply of liquid or gaseous processing fluids to the compacted material 8, a bore 18 extends through the upper piston 4 and terminates in a multiplicity of small bores at the lower end face of the piston 4. A bore 19, extending through the lower piston 4 and terminating in a multiplicity of small bores in the upper end face of the piston 4', serves to withdraw processing fluids from the compacting chamber. Processing fluids may alternatively be supplied and withdrawn through bores (not shown), which are formed in the shell 1*b*.

The processing fluids may alternatively be distributed in the compacting chamber by sieves or perforated plates etc. (not shown).

Insulation 20 is provided between each actuating cylinder and a flange, which is rigid with the shell 1. As a result, the electric current can flow only through the compacted material 8 and will directly heat the same. Whereas electric resistance heating is used in this embodiment, the heat may also be generated by inductive or capacitive radiofrequency heating or by microwave heating if the materials of the shell 1 and the two pistons 4 and 4' are properly selected.

For instance, the shell 1 may consist of ceramic insulating material of high strength.

The design of the present embodiment may be varied in various ways. For instance, a movable lower piston 4' may be used so that the material to be processed is subjected to pressure at both ends. In that case the compacted material can be more easily removed from the compacting chamber when the pistons 4 and 4' have been lowered at the same time.

According to a preferred further feature of the invention, a plurality of compacting units according to the invention may be arranged one beside the other or in a circular series and may be operated in synchronism or so that the impregnating, pulping etc. steps are performed in the first, second, etc. compacting units.

Figure 6:
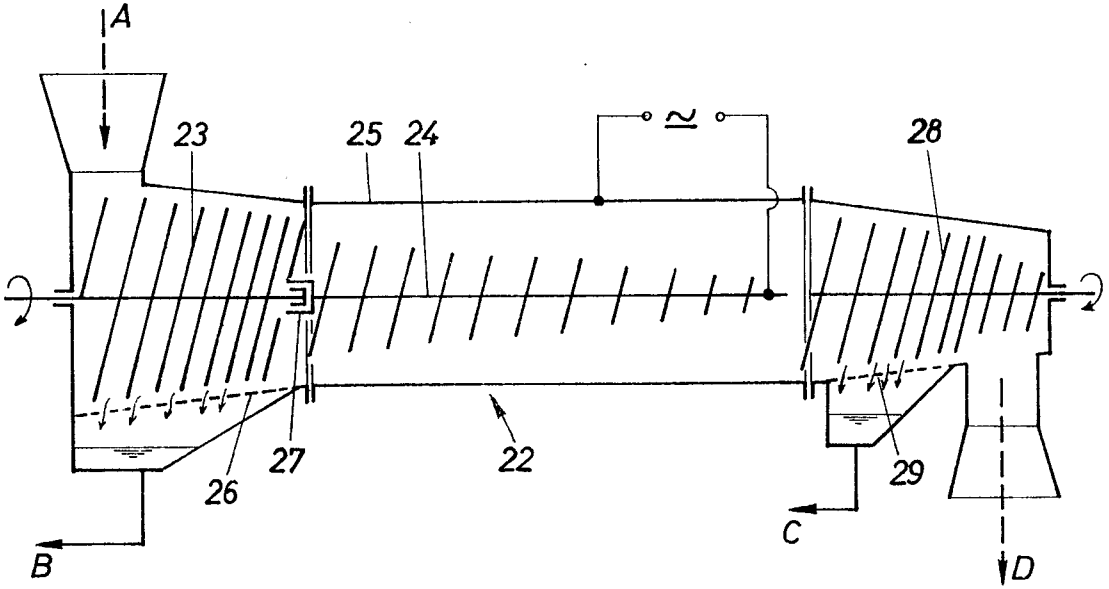
FIG. 6 is a diagrammatic transverse sectional view showing a continuously operating screw extruder used according to the invention.

A screw extruder 22 as shown in FIG. 6 can be used for a continuous production of pulp by the process according to the invention. The impregnated chips can be digested under optimum conditions in such a screw extruder.

A feed screw 23 feeds the material to be compacted, consisting of impregnated chips, into the digesting zone, which is defined by first or screw electrode 24 and a second electrode consisting of the digester housing 25.

The liquor which is squeezed out of the chips as the latter are adjusted to a certain hydromodulus can escape from the screw extruder 22 through a sieve 26 and is recycled to a separate impregnating plant (not shown). The feed screw 23 is connected to the screw electrode 24 by an insulating coupling 27. The digester housing 25 and the screw electrode 24 are provided with contacts, which are connected to an electric power source. The electric current flows through the screw electrode 24 to the digester housing 25 and heats the interposed chips. For instance, if the impregnated chips entering the digester have a hydromodulus 1 and a consistency of 50%, that consistency will decrease toward the outlet to about 30% as the lignin is progressively dissolved.

In the discharge screw 28, the concentration of the pulp is increased to about 55% so that a major portion of the mother liquor is separated by a sieve 29 at an elevated temperature (low viscosity) and a concentration of about 60%.

The residence time in the digesting zone and the mechanical pressure applied to the chips can be adjusted as desired by a control of the ratio of the speeds of the feed and discharge screws.

Figure 7:
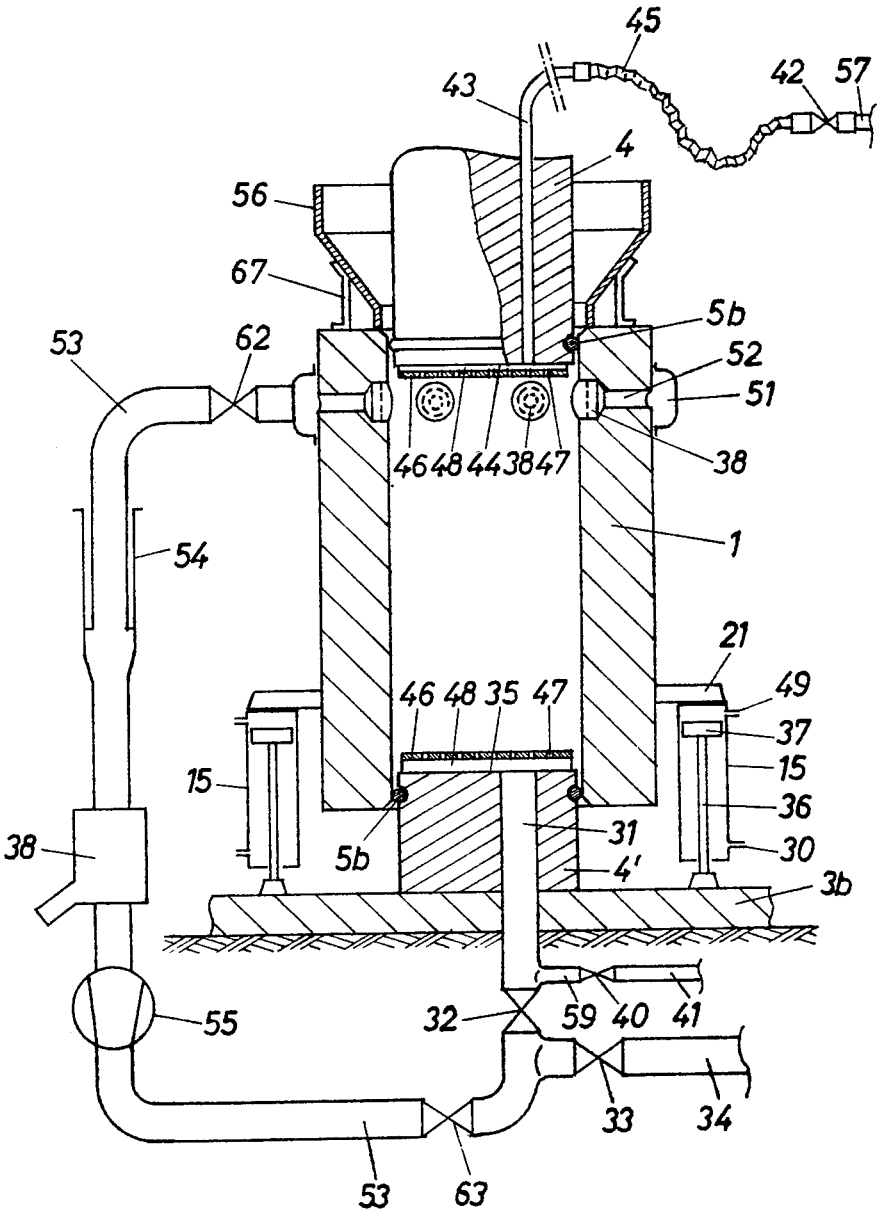
FIG. 7 is a highly simplified vertical sectional view showing another emobidment of the compacting apparatus.

The compacting apparatus shown in FIG. 7 consists substantially of the shell 1, the lower piston 4' and the upper piston 4. The shell 1 is provided with three or more arms 21, each of which rests on an actuating cylinder 15. Each cylinder 15 contains a slidable piston 37, which has a rod 36, which protrudes downwardly from the cylinder 15 and is anchored at the foundation **3*b*. Each double-acting cylinder 15 has two ports 49 and 30. The shell 1 can be raised and lowered in that the cylinders 15 are supplied with oil or another fluid under pressure in a suitable direction. In its uppermost position the shell 1 is substantially spaced apart from the piston 4' so that the compacted material can be laterally removed from the shell between the cylinders 15. The upright cylinders 15 are arranged on a circle, which is concentric to the shell 1, and are laterally spaced apart by a distance which exceeds the inside diameter of the shell 1**.

In the embodiment shown, the lower piston 4' is secured to the foundation **3*b*. A tube 31 extends axially through the piston 4' and is connected by series-connected valves 32 and 33 to a steam conduit 34. An additional valve 63 may be provided. The tube 31 has an opening at the top face 35 of the piston. A filter plate or perforated plate 46 is supported by the piston 4' and spaced above the top thereof and is formed with a multiplicity of small bores 47, which may taper upwardly so that clogging will be avoided and cleaning will be facilitated. The sieve plate 46** may be supported on the top face of the piston by ribs or like stiffeners, not shown.

A distributing and collecting space 48 is defined between the perforated plate 46 and the top face 35 of the piston. A branch pipe 59 is connected to the tube 31 between the piston 4' and the valve 32 and leads through a valve 40 to a pipe 41 for supplying and discharging liquid.

The piston 4' is sealed against the shell 1 by a sealing ring **5*b*, which is held in a peripheral groove formed in the piston 4' near its top face 35 or in the inside surface of the shell 1** near its lower end.

The upper piston 4 is adapted to be moved up and down by hydraulic or mechanical means, not shown. An axial conduit 43 extends through the upper piston 4 and opens at the bottom face 44 thereof. The conduit 43 extends out of the piston and at its other end is connected, e.g. by a hose 45 and a valve 42, to a conduit 57 for supplying and discharging liquid. As for the lower piston 4', the upper piston 4 is provided with a filter plate 46, which has bores 47, which are tapered, if desired. As a result, there is a distributing and collecting space 48 between the bottom face 44 of the upper piston 4 and the filter plate 46. The upper piston 4 is sealed against the shell 1 by a sealing ring **5*b*, which is held in a peripheral groove formed in the piston 4 near its bottom face 44 or in the shell 1** near its top end.

The upper portion of the shell 1 is formed with a plurality of radial passages 52, which are covered at their inner ends by sieve plates 38. To prevent damage to the sealing ring **5*b* by the sieve plates 38, the latter are slightly set back from the inside surface of the shell 1. All radial passages 52 open into an annular conduit 51, which is provided on the outside of the shell 1**.

The ring conduit 51 is connected by a valve 62 to a recycling conduit 53, which comprises a section that is flexible or variable in length, in the present case a telescopic tube 54, and a blower 55. At its other end, the recycling conduit 53 is connected through the valve 32 and any valve 63 to the tube 31, which leads into the lower piston 4'.

At its top end face, the shell 1 may carry a feed hopper 56, which concentrically surrounds the upper piston 4 and is supported by brackets 67. The upper piston 4 can be raised out of the shell 1 so that solids can be fed into the shell 1 through the annular gap between the upper piston 4 and the rim of the shell.

The mode of operation of the compacting apparatus according to the invention will now be explained in connection with the production of pulp from wood chips.

To permit the compacting apparatus to be charged, the upper piston 4 is raised as far as possible and the actuating cylinders 15 are operated to move the shell 1 to its lower end position. Chips which may have been previously introduced into the hopper 56 can now fall into the interior of the shell through the gap which is defined between the perforated plate 46 of the piston 4 and the top rim of the shell 1. Before the end of this charging operation, the chips in the shell 1 may be precompacted by the piston 4. When the desired quantity of chips has been charged into the shell 1, the upper piston 4 is moved to the desired position, in which it extends into the shell 1 to such an extent that the shell 1 is sealed by the sealing ring 5*b*, whereas the radial passages 52 remain open.

The valves 32 and 33 are now opened whereas the valves 40 and 62 and any valve 63 remain closed. Now steam can be supplied into the shell 1 in order to steam the chips.

If the chips charged into the press are very moist, they may be compacted to a desired dryness. When the valve 40 has been opened and all other valves have been closed, the upper piston 4 may be lowered to apply a high pressure of, e.g., 100 to 200 bars, so that liquid will be squeezed out of the chips and be discharged through the bores 47 in the lower perforated plate 46 and through the conduit 41, which is connected to reservoirs.

After this pretreatment the valves are closed. When the conduit 41 has been connected to suitable reservoirs and the valve 40 has been opened, various impregnating liquids may be supplied to the chips in the shell 1. By a supply of hot impregnating liquor or a subsequent heating with steam supplied through conduit 34 and valves 33 and 32, a high percentage of the air that is contained in the pores of the chips can be expelled through the open valve 42 and the conduit 57.

If the chips are to be deaerated to a higher degree, steam at a temperature above 100° C. is supplied into the interior of the shell through the valves 32,33, whereas all other valves are closed. As a result, the impregnating liquor, including the liquor in the chips, is heated above its boiling point. The valves 32, 33 are closed after a short time, and the valve 46 is opened to effect a pressure relief through conduit 57, which may now be open to the atmosphere. The impregnating liquor is then evaporated also in the interior of the chips, and the resulting steam replaces the air within the chips. That sequence may be repeated as often as desired so that all the air can be removed from the chips and thus a perfect impregnation can be effected.

The high pressure of, e.g., 100 to 200 bars which can be applied by the compacting apparatus can be used in the impregnating step in that the upper piston 4 is operated while all valves are closed so that the impregnating liquid is simply mechanically forced into the pores of the wood chips.

It will be apparent that this strictly mechanical impregnation with liquor penetrating the chips can be combined with one or both of the methods of impregnation described hereinbefore because if the air is not sufficiently removed from the chips any residual air in the chips may expand in response to a pressure relief and may then displace at least part of the impregnating liquor.

The chips which have been impregnated to the desired degree or have been perfectly impregnated may now be compacted to any desired hydromodulus. They are generally compacted to a hydromodulus of about 0.5 to 2 and preferably of about 1. A hydromodulus of 1 means that the weight of the dry chips is approximately as high as the weight of the impregnating liquor which has been absorbed by the chips.

Compacting is effected in that the upper piston 4 is lowered. The liquor which is thus squeezed off can flow through the valve 40 into the conduit 41.

For the final digestion of the chips, the upper piston 4 is raised to the position shown in the drawing at a time when the shell 1 is filled with compacted chips, e.g. to one-half of its capacity and the space above the chips is filled with a steam-air mixture. The valves 32, 33 are now opened and steam is blown into the shell 1 through said valves. The temperature of the steam is, e.g., 10° to 50° C. above the temperature desired for the final digestion; and that temperature may be about 170° to 220° C. The pressure of the steam which is then supplied is approximately the equilibrium pressure at the highest digesting temperature which has been selected, i.e. the steam consists of superheated steam and the supply of steam ceases automatically when the desired digesting temperature has been reached.

The steam which is supplied condenses on the relatively cold chips and heats the latter by the heat of condensation and by heat conduction.

When the valve 62 has been opened, the surplus steam can be circulated by the blower 55 through the sieves 38, the passages 52, the annular conduit 51, the valve 62, the recycling conduit 53, any valve 63, the valve 32 and the tube 31. The area of the bores 47 in the sieve plate 46 associated with the lower piston 4' and the velocity of the steam of steam-air mixture are so selected that the impregnated chip particles will be agitated by and intensely mixed with the turbulent steam or steam-air mixture flowing in contact with the chip particles. At this stage the chip particles may already be described as a cooked product. Said agitation of the chip particles need not result in the formation of an ideal fluidized bed because it is sufficient to contact the chip particles with a turbulent flow so that heat is transferred quickly and homogenously from a statistical aspect. If the shell is filled to a high degree, the chip particles will be agitated with high turbulence, whereas in case of a filling to a lower degree the resulting turbulence may be low and only a slow motion may be imparted to the chips.

As soon as the desired maximum digesting temperature has been reached, the circulation of the steam of steam-air mixture is interrupted. The cooked product is held at the maximum temperature for a short time, e.g., for about 10 hours to about 6 minutes. Thereafter, the valves 40 and 42 are opened and all other valves are closed and the upper piston 4 is lowered to compact the cooked product under the highest possible pressure. The mother liquor which is thus squeezed off flows through the conduits 41 and 57, the valves of which have been suitably actuated. The higher the compacting pressure in that step, the less water will be required in the subsequent washing operations.

At this stage the pressure is usually not suddenly relieved because the sudden pressure relief of the entire cooked product would result in a strong generation of steam and possible damage to the fibers. In some cases, however, a sudden pressure relief may be desired in order to obtain an even more highly concentrated waste liquor.

The cooked product is compacted to a hydromodulus of 1 or possibly lower than 1, based on the nature of the desired pulp. As a yield of about 50% is obtained, about one-half of the wood substance has been dissolved and squeezed off with one-half of the original impregnating liquor so that in this example the shell is filled to one-fourth of its capacity. The shearing forces applied at the digesting temperature assist the rapid separation of the individual fibers.

After the treatment described hereinbefore, the upper piston may be raised to the position shown and washing or bleaching liquors in any desired quantity may now be fed into the shell 1 through the valve 42 and/or valve 40 so that there may be supernatant liquor above the compact cooked product and a displacement washing operation may be effected. For this purpose the liquid is forced, e.g., by the upper piston 4, through the cooked product so that the fresh liquid replaces the mother liquor. A so-called diluting washing operation may alternatively be carried out in that, e.g., the piston 4 is sufficiently lowered from its illustrated position to cover the sieves 38, whereafter the valve 42 is opened and air is supplied through the conduit 34 and the valves 32, 33 and flows through the cooked product and the liquid so that the cooked product and liquid are blended, whereafter the air escapes through the conduit 57.

The cooked product may then be recompacted.

To remove the compacted cooked product from the shell, the valve 40 and/or the valve 42 is opened and the piston 4 is lowered onto the cooked product without applying a substantial pressure thereto. The actuating cylinders are then operated to raise the shell to its uppermost position, whereafter the cooked product is laterally removed through the gap between the sieve plate 46 associated with the lower piston 4' and the lower rim of the shell 1.

The embodiment which has been described may be modified in various respects within the scope of the invention.

For instance, the upper piston 4 may also be provided with an axial tube which corresponds to the tube 31 in the lower piston 4' and is directly connected to the recycling conduit 53 by a valve which corresponds to the valve 62.

In that case the passages 52, the associated sieves 38 and the annular conduit 51 are omitted. Besides, the lower piston 4' may also be vertically movable; in that case the shell 1 will be stationary. In that embodiment the compacting apparatus will be operated as described, i.e. the upper piston is moved whereas the lower piston remains stationary. When it is desired to discharge the cooked product the two pistons which hold the cooked product between them are lowered until the perforated plate associated with the upper piston is flush with the lower rim of the shell 1. The blower 55 may be reversible so that it can be operated to blow air from the outside through the valve 62, the annular conduit 51 and the sieves 38 or in the modified embodiment through the corresponding axial tube and then through the bores 47 to clean the latter. Adjacent to the sieves 38, the inside surface of the shell 1 may have a portion which is slightly larger in diameter and merges gradually into the adjacent portions of said inside surface; this will permit the sealing ring **5*b* to slide more easily over the sieves. The recycling conduit may contain a cyclone or the like (indicated at 38) for removing any entrained solids from the steam or steam-air mixture flowing in the recycling conduit 53. The recycling conduit 53** may contain a heat exchanger (not shown) for reheating the recycled steam or steam-air mixture. The apparatus may be charged in a different manner, e.g. through a suitable tube in the upper piston or in the shell, and may be charged by gravity or pneumatically or in a different manner.

A special advantage afforded by the compacting apparatus according to the invention resides in that all usual kinds of chips or other cellulose-containing materials can be processed. For instance, chips to be processed in intermittently operated sulfate pulping plants usually have a length of 16 to 18 mm, a width of 10 to 17 mm, and a thickness of about 3 mm, on an average. Chips to be processed in modern sulfate pulping plants for continuous operation usually have a length of 38 mm, a width of 38, mm and a thickness of 6 mm, on an average. In both cases the variations from said average dimensions may be substantial.

Increasing efforts have recently been made to process chips having more exactly defined dimensions, and chip sorters have been disclosed by which oversize and undersize chips can be effectively removed. Ideal chips would have a thickness (in a radial direction with respect to the tree trunk) of 2 to 4 mm, a length (in the longitudinal direction of the fiber) of 15 to 30 mm, and any desired, but substantially uniform, width, e.g., of 10 to 20 mm. A chip material containing a very high percentage of such chips can be obtained with an effective chip sorter. A relatively small variation of the dimensions and a substantially uniform thickness of the chips are more important than the absolute size of the chips.

The use of a homogeneous chip material will afford advantages for a uniform impregnation and heating so that a pulp of higher quality having a lower content of splinters and uncooked material will be obtained. If the cooked product is turbulently heated with steam or a steam-air mixture, the use of chips having smaller size variations may have the result that the velocity of flow does not exceed the velocity at which the fines descend is lower than the velocity at which the largest particles are disintegrated.

The bores 47 in the sieve plates 46 are of any desired shape and are usually round. The size of the holes must meet two requirements: They must ensure an optimum compacting for a removal of liquid and an optimum supply of gases for agitating and/or heating. Both actions are preferably performed through the same bores although separate bores, may be provided for both actions. In that case the gaseous heating fluid might be injected through a plurality of larger openings, which can be separately closed. The hole diameter will be in the range of 0.2 to 10 mm, preferably 0.5 to 6 mm, particularly 1 to 3 mm. These requirements can be met by the provision of larger holes covered with a sieve which has openings of the desired size.

The center spacing of the holes is preferably selected so that open areas of 1 to 90%, preferably 3 to 80%, particularly 10 to 70% and especially 20 to 50% are obtained with holes having the stated sizes. For instance, circular holes 2 mm in diameter may have a center spacing of 4 mm so that the open area is about 23%.

The sieve plates 46 may be self-supporting and may have such a thickness that they will withstand the pressure which will occur in the compacting apparatus, or may consist of perforated sheet metal elements carried by ribs of a thicker plate, which has larger bores. The holes may have the above-described diameter on the side remote from the associated piston and may flare toward said piston so that liquid can be more easily drained and clogging will be avoided.

All or part of the bores may be inclined from the axis of the shell in order to provide for an additional motion and mixing of the defibrated material. One or more openings which are larger in diameter than the bores in the associated sieve plates may be provided in the end face of the pistons and may be eccentrically arranged and adapted to be separately opened and closed so that the mixing of the difibrated material with gaseous fluids which are discharged will be improved.

Depending on the manner in which the steam or the steam-air mixture is supplied, the fluid may flow at different velocities to different portions of the sieve plate 46 associated with the lower piston. This can be accomplished by the Moeller shearing flow process, the Polysius process and the Fuller-Peters quadrant process. In the latter process the plate against which the flow is directed (sieve plate) is divided into four equal sectors (quadrants) of a circle and individual quadrants are supplied with air at a higher velocity than the other in successive intervals of time. In that case four inlet openings are required and must be suitably controlled. Immediately after the impregnation, e.g. when the chips have been compacted to the selected hydromodulus, a flow of a gaseous fluid at a high rate through successive parts of a piston cross-section, e.g. through individual quadrants, will generally be required in order to loosen up the material.

The injection of the steam, air or steam-air mixture may be effected intermittently or with pressure surges so that the material will be raised in an irregular manner and will be intensely mixed.

The velocities of the gaseous fluid measured in the free-cross-section of the shell (in the bores in dependence on the open area of the sieve plate) will depend on the nature of the cooked product, its on particle size and its on moisture content (hydromodulus), on the thickness of the layer, on the temperature and on the desired rate of temperature rise and will generally amount to 0.5 to 20 meters per second, preferably to 1 to 15 meters per second and particularly to 3 to 10 meters per second. These velocities may be exceeded for short times if the fluid is injected intermittently or with pressure surges.

An intermittent injection of steam into the closed compacting apparatus may be desirable so that the steam will condense on the relatively cool cooked product. This is succeeded by another injection at a relatively high velocity to agitate the cooked product. In such case the annular conduit 53 (between 38 and 63) may be omitted and the chip may be heated by intermittently injected steam until the digesting temperature is reached. In an alternative arrangement, steam-air-mixture may be constantly circulated by the blower 55 through the open recycling conduit 53 and additional steam may be injected intermittently or continuously. Both actions may also be performed in succession.

What is claimed is:

1. A compacting apparatus for producing pulp from impregnated, cellulose-containing starting materials, comprising a shell having an interior and a pair of ends, which shell contains on one end thereof a piston having an inner end face and on the other end thereof a shutting means having an inner end face, the interior of the shell and the confronting end faces of the piston and the shutting means defining a compacting chamber which contains the material to be compacted, perforated means associated with at least one of the shutting means, the shell and the piston for supplying and discharging processing fluids to and from the compacting chamber, wherein at least the piston and the shutting means are movable relative to each other, and the shell is movable relative to the piston and the shutting means, and a heating means for heating the material in the compacting chamber.

2. A compacting apparatus according to claim 1, wherein the shutting means is a piston which is stationary.

3. A compacting apparatus for producing pulp from impregnated, cellulose-containing starting materials, comprising a shell having an interior, an upper end and a lower end, which shell contains on the upper end thereof an upper piston having an inner end face and on the lower end thereof a shutting means having an inner end face, the interior of the shell and the confronting end faces of the piston and the shutting means defining a compacting chamber which contains the material to be compacted, perforated means associated with at least one of the shutting means, the shell and the piston for supplying and discharging processing fluids to and from the compacting chamber, wherein the piston and the shutting means are movable relative to each other and the shell is movable relative to the piston and the shutting means, and a heating means for heating the material in the compacting chamber.

4. A compacting apparatus according to claim 3, wherein the shutting means is a lower piston contained in the lower end of the shell.

5. A compacting apparatus according to claim 4, wherein the lower piston is stationary.

6. A compacting apparatus according to claim 4, wherein the shell has a centerline and the pistons are slidable along said centerline, the upper piston being adapted to be hydraulically raised and lowered, and the lower piston being rigidly mounted on a bottom plate.

7. A compacting apparatus according to claim 4, wherein the upper piston has at least one bore positioned transversely therewithin, which terminates in numerous smaller bores on the lower end face of the upper piston, and the lower piston has at least one bore positioned transversely therewithin, which terminates in numerous smaller bores on the upper end face of the lower piston.

8. A compacting apparatus according to claim 3, wherein the perforated means for supplying fluids to and discharging fluids from the compacting chamber comprises a filter plate having bores therethrough, which filter plate is associated with and spaced inwardly from one of the inner end face of the piston, the inner end face of the shutting means and at least a portion of the interior of the shell, and a tube integral to said one of the piston, the shutting means and the shell, said tube opening into the space between said one of the inner end face of the piston, the inner end face of the shutting means and at least a portion of the interior of the shell and the filter plate, said tube communicating exteriorly with valve means which are selectively connectable to sources for fluids.

9. A compacting apparatus according to claim 8, wherein a plurality of perforated means are provided.

10. A compacting apparatus according to claim 9, wherein a recycling conduit is provided comprising a blower connected at one end to valve means which communicates with the tube of one of the piston and the shutting means and connected at the other end to valve means which communicates with the tube of the shell.

11. A compacting apparatus according to claim 8, wherein said heating means comprises means for introducing a gaseous heating fluid selected from the group consisting of hot air, hot gases, steam, steam-air mixtures and steam-gas mixtures through said valve means.

12. A compacting apparatus according to claim 3, wherein the material contained in the compacting chamber constitutes a resistive electric load and heating thereof is accomplished by resistance heating in which the heating means comprises a pair of contacts, each but not both being attached to one of the piston, the shutting means and the shell, and said pair of contacts being electrically connected to the terminals of an electric source so that when an electric current is supplied, the current flows only through said material contained in the compacting chamber.

13. A compacting apparatus according to claim 12, wherein the piston and the shutting means each have one of the pair of contacts attached thereto and wherein the inside of the shell is lined at least in part with electrically insulting material so that when an electric current is supplied, the current flows only through said material contained in the compacting chamber.

14. A compacting apparatus according to claim 3, wherein the shell is a vertical cylinder and is movable along its vertical axis to a position above the inner end face of the upper piston, a plurality of actuating cylinders disposed along a circle that is concentric to the shell are provided for moving the shell, the clearance between each two adjacent cylinders being at least as large as the inside diameter of the shell, and wherein a feed hopper is provided, which is carried by the top end of the shell and has an interior portion adapted to surround the upper piston, the upper piston being adapted so that its inner end face can be raised into the interior of the feed hopper when the shell is in its lowermost position to allow starting material to be fed into the shell.

15. A compacting apparatus according to claim 14, wherein both pistons are movable in one of the same sense and mutually opposite senses relative to the shell.

16. A compacting apparatus according to claim 3, wherein the shell is adapted to be raised and lowered by actuating means selected from one of hydraulic cylinders, pneumatic cylinders and a power screw, and electrical insulation is provided between the shell and said actuating means.

* * * * *